US010398248B1

(12) United States Patent
Burch, Jr.

(10) Patent No.: US 10,398,248 B1
(45) Date of Patent: Sep. 3, 2019

(54) ADJUSTABLE DRAPERY FORM STRUCTURE

(71) Applicant: Ivan Curtis Burch, Jr., Carmel, IN (US)

(72) Inventor: Ivan Curtis Burch, Jr., Carmel, IN (US)

( * ) Notice: Subject to any disclaimer, the term of this patent is extended or adjusted under 35 U.S.C. 154(b) by 224 days.

(21) Appl. No.: 15/234,899

(22) Filed: Aug. 11, 2016

(51) Int. Cl.
*A47H 13/14* (2006.01)
*A47H 13/04* (2006.01)

(52) U.S. Cl.
CPC ..... *A47H 13/14* (2013.01); *A47H 13/04* (2013.01)

(58) Field of Classification Search
CPC ..... A47H 13/04; A47H 13/14; A47H 13/16; A47H 23/02; A47H 23/04; D06J 1/12; Y10T 16/353
See application file for complete search history.

(56) References Cited

U.S. PATENT DOCUMENTS 1,819,240 A * 8/1931 Harrison ..... A47H 13/14 160/348
2,522,358 A * 9/1950 Franson ..... A47H 13/14 160/348
2,544,516 A * 3/1951 Walters ..... A47H 13/14 160/348
2,559,072 A * 7/1951 Hasselwander ..... A47H 13/14 160/341
2,648,379 A * 8/1953 Bishop ..... A47H 13/16 16/87.2
3,081,819 A * 3/1963 Lydard ..... A47H 13/16 160/348
3,114,186 A * 12/1963 Olsen ..... A47H 13/04 24/345
3,132,686 A * 5/1964 Judovits ..... A47H 13/16 112/427
3,335,786 A * 8/1967 Weisberg ..... A47H 13/14 160/348
3,399,712 A * 9/1968 Weisberg ..... A47H 13/16 160/348
3,527,284 A * 9/1970 Nelson ..... A47H 13/14 160/348
3,645,318 A * 2/1972 Holzlehner ..... A47H 13/14 160/348
3,735,795 A * 5/1973 Broek ..... A47H 13/00 160/348

(Continued)

*Primary Examiner* — Katherine W Mitchell
*Assistant Examiner* — Abe Massad
(74) *Attorney, Agent, or Firm* — Derek Pressley

(57) ABSTRACT

An adjustable drapery form structure provides form to the header portion of a drapery panel. The structure has a platform and a form member capable of surrounding an end of the platform. A track, with discrete stops along it, is oriented perpendicularly to that end of the platform. A hanger member that attaches to a drapery rod can be selectively adjusted between track stops. Trimming notches at an end of the form member may be removed to provide additional adjustability to the structure.
The drapery panel is fastened to the form member and then the form member is bent longitudinally into a U-shape. The ends of the form member are then connected to the platform by catches, one on each side of the track, which restrain them. The number of structures and distance between them can be adjusted depending upon the width of the drapery panel and desired aesthetic affect.

9 Claims, 4 Drawing Sheets

(56) References Cited

U.S. PATENT DOCUMENTS

| | | | | | |
|---|---|---|---|---|---|
| 3,785,426 | A | * | 1/1974 | Sperling | A47H 13/14 160/327 |
| 3,881,217 | A | * | 5/1975 | Bytheway, Jr. | A47H 13/00 16/87.2 |
| 4,053,009 | A | | 10/1977 | Edlin | |
| 4,055,211 | A | * | 10/1977 | Sperling | A47H 13/16 16/87.2 |
| 4,166,308 | A | * | 9/1979 | Schmitz | A47H 13/14 160/348 |
| 4,217,676 | A | | 9/1980 | Terrones | |
| 4,390,055 | A | | 6/1983 | Fenley | |
| 5,857,511 | A | * | 1/1999 | Judkins | A47H 13/14 160/348 |
| 7,730,931 | B2 | | 6/2010 | Stern | |

* cited by examiner

ADJUSTABLE DRAPERY FORM STRUCTURE

BACKGROUND OF THE INVENTION

This invention relates to structures used in conjunction with window coverings, and more particularly to structures that provide form to flexible window covering materials, such as drapery fabric.

It has been said that what makes a house a home is beautiful fabrics, and one of the most noticeable use of fabrics in a home are draperies. Draperies are versatile in that they are both functional, e.g., providing privacy and blocking sunlight, as well as aesthetic, draperies contribute to a room's style. A drapery panel's pleats are similarly versatile in that they allow it to expand or neatly contract and also add an additional point of design interest.

Draperies are typically made of softer fabrics which easily fold into a vertical "stack" at the sides of a window when opened. But these softer materials tend to lose their shape at the header (the upper end portion of a drapery panel when hung) when they are contracted together into a stack, resulting in a less desirable appearance. Historically, many different types of drapery "stiffeners" have been used in the header to provide it form, such as stiff fabric, cords, tapes and/or elastics. Structures made of metal and/or plastic have also been developed to support the drapery fabric and provide form to the header. However, these form structures have not incorporated features that provide for their adjustment in relation to the particular attributes of the drapery panel being used (e.g., height and width of the panel, weight of the fabric). Form structures used to date often have to be modified in some way from their originally intended use or construction in order to achieve a favorable outcome from their use. That is, they often must be positioned in relation to the drapery panel in some way that differs from its originally intended placement or they typically require unintended structural modifications to achieve a desired outcome, often requiring multiple attempts.

For example, the stiffener disclosed in U.S. Pat. No. 4,053,009 does not allow for adjusting the amount of drapery rod coverage (effective width) that a drapery panel may provide due to the fact that the distance between the form elements are fixed. If the effective width of the panel needs to be changed to provide a desirable outcome, some sort of alteration to the stiffener must be made in order to achieve a desirable outcome as a result of its use.

Another shortcoming of the prior art is shown in U.S. Pat. No. 5,857,511, with the lack of provisions for adjusting the form structure's hanging element. Drapery panels differ in weight depending upon size and type of fabric, and often require adjusting the position of the hanger element in relation to the rest of the form structure in order to make the header portion of the drapery panel hang level.

One broad objective of the present invention is to provide a structure that overcomes these shortcomings, in addition to others that will become more apparent after reading the following description in conjunction with viewing the accompanying drawings.

SUMMARY OF THE INVENTION

One aspect of the present invention is an adjustable drapery form structure having a platform and a flexible form member. The platform has a front end, back end, and a track thereon that is oriented perpendicularly to its front end. The track has discrete stops along it. The flexible form member is capable of flexibly surrounding the front end of the platform so that flexure of the form member around the front end at least partially encircles the track.

Another aspect of the present invention is a drapery assembly having a drapery panel, first and second form members, and first and second platforms. The form members are spaced at a distance apart creating a span of drapery panel between the form members. The form members are fastened to the header portion of the drapery panel, fixing alignment of their upper longitudinal edges in parallel with the top edge of the panel. The platforms are adjacent inner faces of each of the form members, respectively, and restrains their opposite ends, bending them longitudinally into U-shapes. Each platform has a track thereon, oriented perpendicularly to the inner faces of each of the form members.

The objects and advantages of the present invention will be more apparent upon reading the following detailed description in conjunction with the accompanying drawings.

DETAILED DESCRIPTION OF PREFERRED EMBODIMENT

Figure 1:
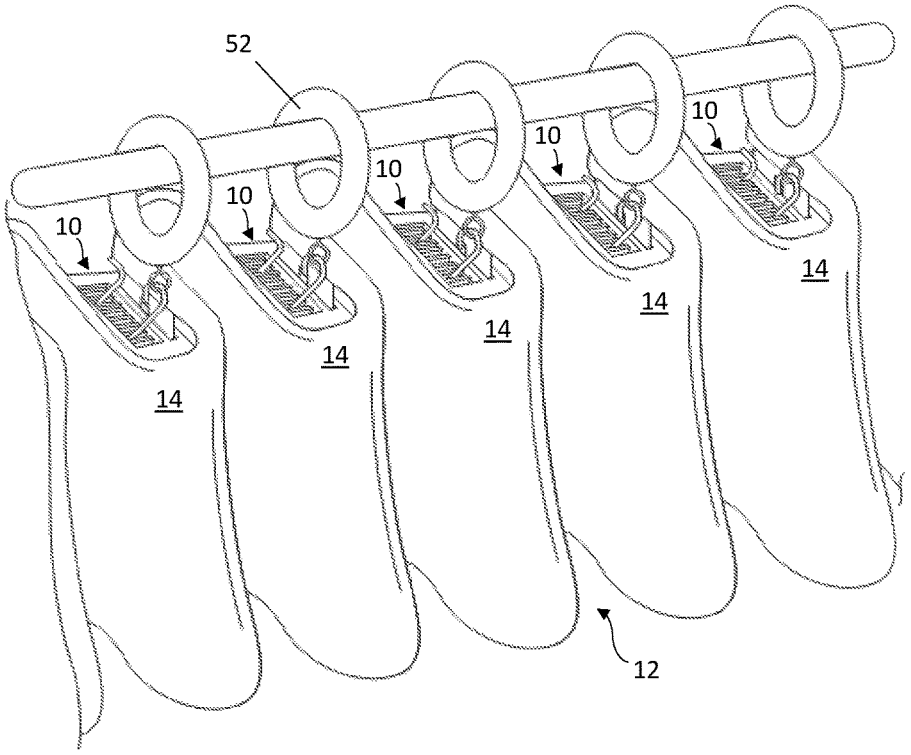
FIG. 1 is a perspective view of five adjustable drapery form structures according to the present invention, having a drapery panel hung therefrom.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further application of the principles of the invention illustrated therein being contemplated as would normally occur to one skilled in the art to which the invention relates.

FIG. 1 shows five of a preferred embodiment of an adjustable drapery form structure 10 according to the present invention being used to hang drapery panel 12 and provide shape to the panel's header portion 14. The drawing of FIG. 1 is shown with form structures 10 tilted downward slightly at their fronts to reveal components and different aspects of the present invention. In everyday use, it is contemplated that form structures 10 would be installed and adjusted so that they would hang generally level with the floor, and therefore be hidden from view by drapery panel 12. Major components of form structure 10, as perhaps best shown in FIG. 2, include platform 16, form member 18 and hanger member 20.

Figure 2:
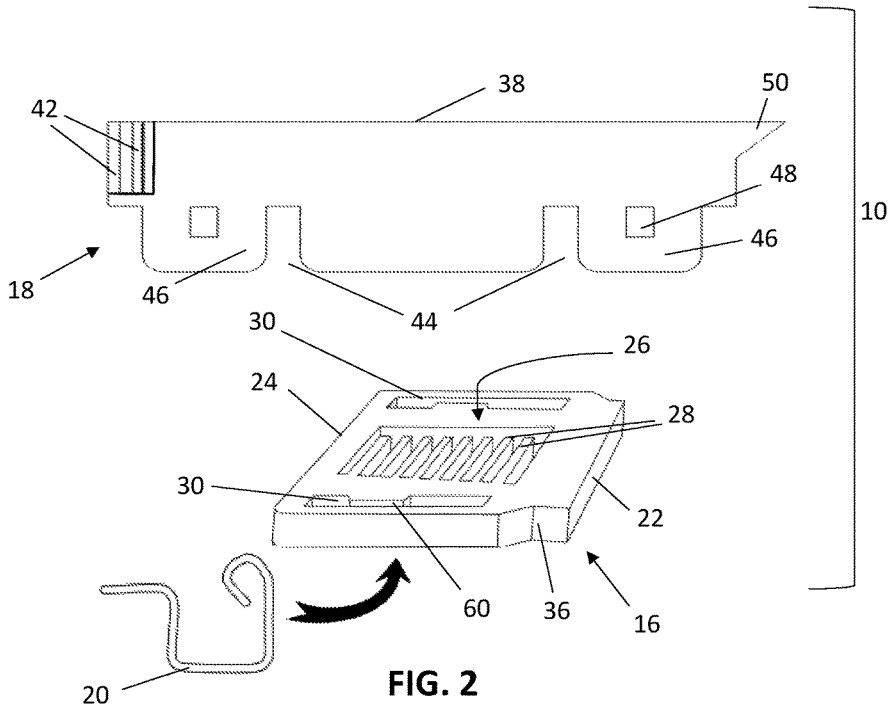
FIG. 2 is a perspective view of one of the adjustable drapery form structure of FIG. 1, disassembled.
Figure 3:
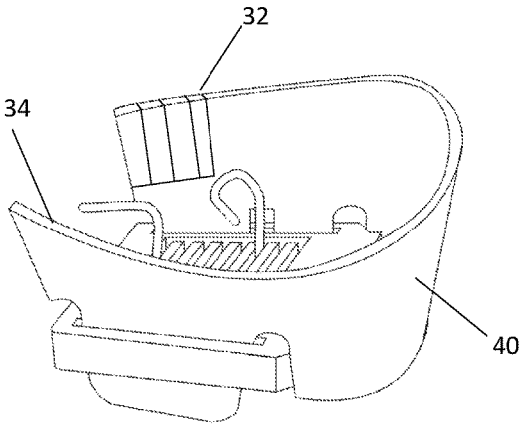
FIG. 3 is a perspective view of the adjustable drapery form structure of FIGS. 1 and 2, assembled.
Figure 4:
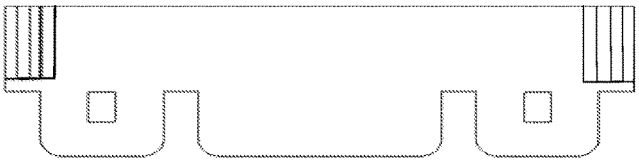
FIG. 4 shows another form member used with the form structure of FIG. 1.
Figure 5A:
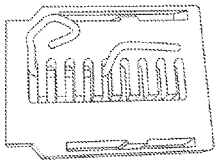
FIGS. 5A, 5B and 5C show one aspect of adjustability of the drapery form structure of FIGS. 1-3.
Figure 5B:
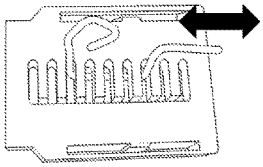
Figure 5C:
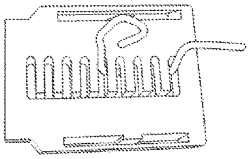

Platform 16, generally defined by front end 22 and back end 24, is preferably made of durable plastic, such as various types of high-density polyethylene, polypropylene or polycarbonate, for example. It may also be made of different varieties of wood or, perhaps less preferably, different types of metal such as aluminum or galvanized sheet metal, for example. Adjustment track 26 has multiple discrete stops 28 which can engage hanger member 20 when assembled, such that it may be selectively adjusted, as shown in FIGS. 5A-4C, in a generally perpendicular direction to form member 18 when assembled on platform 16, as shown in FIG. 3. Catches 30, shown in FIGS. 2 and 3 as retainer slots, engage form member 18 when assembled, restraining the ends 32, 34 of form member 18 and thereby deforming it longitudinally. Corner recesses 36 also engage form member 18 when assembled to provide additional stability of form member 18 when assembled upon platform 16.

Figure 6:
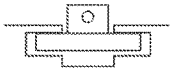
FIGS. 6 and 7 show an alternate embodiment of an adjustment track according to the present invention.
Figure 7:
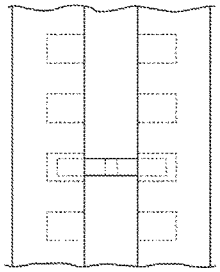

FIGS. 6 and 7 show a schematic representation of one alternative embodiment of an adjustment track with multiple discrete stops according to the present invention. In this embodiment, the hanger member is a plastic follower that is slidably adjustable between the discrete stop in the same fashion that hanger member 20 is adjustable in FIGS. 4A-4C. The follower may have an eyelet as shown, or may alternatively have a hook as a connector.

Figure 8:
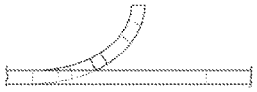
FIGS. 8 and 9 show another alternate embodiment of an adjustment track according to the present invention.
Figure 9:
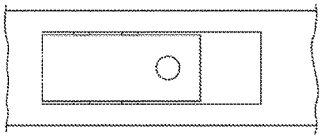

FIGS. 8 and 9 show a schematic representation of another alternative embodiment of an adjustment track with multiple discrete stops according to the present invention. In this embodiment, the hanger member is a bendable beam that is cantilever attached by a living hinge type structure to the rest of the platform. The beam has multiple breakable connection points along its sides to allow discrete adjustment stops to its deformation. The beam may have an eyelet as shown, or may alternatively have a hook as a connector.

Figure 10:
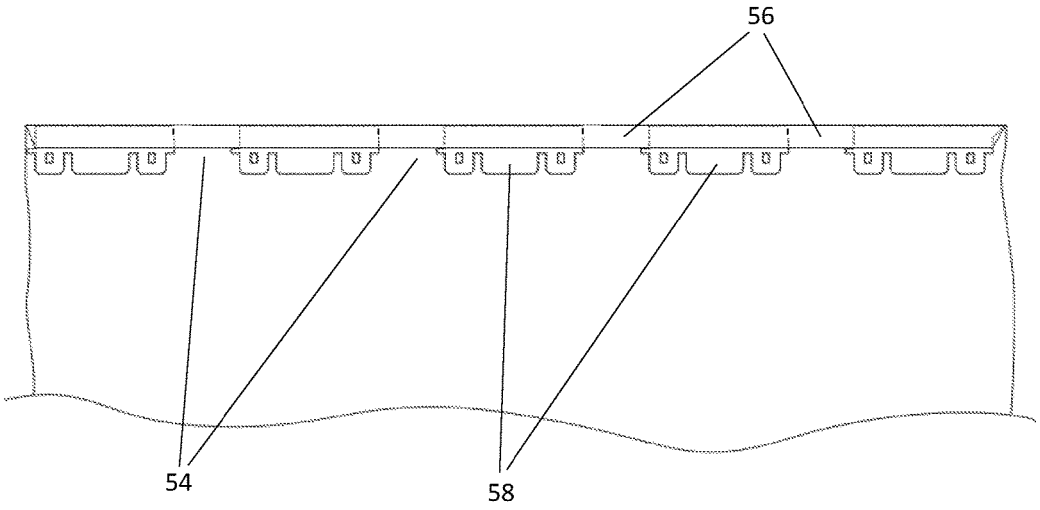
FIG. 10 shows the five form members and drapery panel of FIG. 1 prior to their connection to the five platforms of FIG. 1.

Form member 18 is preferably made of flexible plastic, such as various types of low-density polyethylene or polypropylene, for example. It may also be made of other similarly flexible, but perhaps less durable materials, such as cardboard or cardstock, for example. Major features include top longitudinal edge 38, center span 40, trimming notches 42, stability notches 44, connector tangs 46 with catch apertures 48 and stand-off protrusion 50. FIG. 4 shows another version of the form member for use with header form structures that are used in the middle part of the drapery panel. For example, the drapery shown in FIG. 1 employs 2 end forms, having the protrusion 50, as previously mentioned, and three inside forms as shown in FIG. 4, which have trimming notches on either end. FIG. 10 shows that form members are generally flat prior to assembly on platform, such that they may be laid flat against the header portion of a drapery panel.

Hanger member 20 is shown in FIGS. 1-3 and 5A-5C as a drapery hook made of No. 10 AWG stainless steel wire that may be adjusted along adjustment track as shown in FIGS. 4A-4C. Various types of drapery hooks may be used in conjunction with this embodiment of the present invention which achieve the functional goal of providing an attachment point for form structure 10 to a drapery rod ring or rings 52 as shown in FIG. 1, or to a sliding carrier within a traverse rod, not shown.

INSTALLATION

FIG. 10 shows form structures are installed by first aligning top longitudinal edges 38 of each form member 18 generally parallel to the top edge of drapery panel 12 where header portion 14 terminates. The number of form members 18 and span 54 between them can be adjusted depending upon the width of drapery panel 12 and desired aesthetic affect. Each form structure 18 is used individually to provide form to the drapery, but may be used in groups to provide one overall, larger impression. FIGS. 2 and 3 shows that trimming notches can be selectively removed to provide additional adjustability to the overall effect. Trimming notches may be removed to increase the overall width of the drapery. For example, removal of each ¼ inch notch adds approximately 2 inches to the overall width of the drapery panel in applications utilizing five form structures, as shown in FIG. 1.

Another aspect of adjustability that form structures 10 provide is adjustment of the overall height of drapery panels. Excess drapery panel material 56 may be gathered and secured to inner face 58 of form member 18 during installation, effectively changing the height of drapery panel 12. As can perhaps best be appreciated when viewing FIG. 1, excess drapery material 56 will not be visible after assembly and installation of the form structures 18 on a drapery rod. (As previously mentioned, the form structures shown in FIG. 1 are tilted downward slightly to reveal aspects of the present invention.) Drapery panel 12 may be secured to form member 18 in various ways, such as but not limited to, stapling, pinning, gluing or using a hook and loop fastener system, popularly known and sold in connection with the trademark Velcro, for example. It should be appreciated when viewing FIG. 1 and FIG. 3 together, that drapery material should not be fastened to tangs 46, so that they may be inserted into retention slots 30 of platform 18. In the preferred embodiment shown, there is about a 1-inch area in which excess drapery material 56 can be gathered. As shown, a preferred way to gather the excess material is to consecutively fold over the edge of the material in 1 inch increments. Alternatively, the height of the drapery panel may be cut and then hemmed, prior to installation of the form members. An extra 3 inches of drapery panel height should be ideally allotted for securing the drapery panel to the form structures in this type of installation. Next, form member 18 is connected to platform 16 by longitudinally bending it and inserting tangs 46 into catch retention slots 30 such that catch apertures 48 engage slot studs 60. This restrains ends 32, 34 of form member 18 and deforms it generally into a U-shape, providing curved form to header portion 54 of drapery panel 12.

Hanger member 20 may be placed in adjustment track 26 before or after form member 18 is connected to platform 16. Selective placement of hanger members along adjustment tracks during assembly of form structures provide means for adjustably leveling the pitch of form structures when installing them on drapery rod, resulting in a level, more aesthetically pleasing appearance.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

What is claimed is:

1. An adjustable drapery form structure, comprising:

a platform having a front end, a back end and side surfaces therebetween;

an adjustment track on said platform, oriented perpendicularly to said front end;

a drapery hook shaped for engagement with said adjustment track;

a pair of catches on said platform, one of said catches on each side of said track; and a flexible form member with at least two tangs, wherein flexure of said form member around said front end of said platform and engagement of said tangs with said catches results in a U-shaped span surrounding said front end and said side surfaces of said platform, such that engagement of said drapery hook at points along said adjustment track changes distance between said drapery hook and said front end of said platform to adjust balance of said form structure when hung by said drapery hook; and wherein the adjustment track is configured to provide adjustment of the respective drapery hook relative to the front end of the platform in a direction perpendicular to a plane defined by a drapery panel attached to the form structure.

2. The adjustable drapery form structure of claim 1, wherein said catches are spaced at a distance apart from said track to provide space within said U-shaped span for rotation of said hook to accommodate connection of said hook to drapery rod support structures.

3. The adjustable drapery form structure of claim 1, further comprising a protrusion on an end of said form member, wherein flexure of said form member around said front end of said platform results in said protrusion protruding beyond said back end of said platform.

4. The adjustable drapery form structure of claim 3, further comprising a set of graduated markings on said form member.

5. The adjustable drapery form structure of claim 4, wherein said graduated markings comprise scorings in the surface of said form member, spaced at a pre-determined equal distance apart.

6. A drapery pleat form structure, comprising:

a platform having a front end, a back end and side surfaces therebetween;

an adjustment track on said platform for leveling an attached drapery panel's header;

a pair of catches on said platform, one of said catches on each side of said adjustment track; and an elongate, flexible form member with a tang on each opposing end thereof, wherein flexure of said form member around said front end of said platform and engagement of said tangs with said catches results in arrangement of a drapery panel connected to said form member into a U-shape surrounding said front end and said side surfaces of said platform, allowing placement of drapery hooks engaged with said adjustment track to be positioned within said U-shape; and wherein the adjustment track is configured to provide adjustment of the respective drapery hook relative to the front end of the platform in a direction perpendicular to a plane defined by the drapery panel.

7. The drapery pleat form structure of claim 6, wherein said adjustment track is oriented perpendicularly to said front end of said platform.

8. The drapery pleat form structure of claim 7, further comprising a protrusion on an end of said form member that, when said tangs of said form are engaged with said catches of said platform, said protrusion extends beyond said back end of said platform.

9. The drapery pleat form structure of claim 6, wherein said catches are spaced at a distance apart from said track to provide space within said U-shaped span for rotation of a hook placed within said track to accommodate connection of the hook to drapery rod support structures.

* * * * *